US007748059B2

(12) United States Patent
Arai

(10) Patent No.: US 7,748,059 B2
(45) Date of Patent: Jul. 6, 2010

(54) HELMET

(76) Inventor: Michio Arai, 12, Azuma-cho, 2-Chrome, Ohmiya-Ku, Saitama-Shi, Saitama-Ken (JP)

( * ) Notice: Subject to any disclaimer, the term of this patent is extended or adjusted under 35 U.S.C. 154(b) by 27 days.

(21) Appl. No.: 12/010,365

(22) Filed: Jan. 24, 2008

(65) Prior Publication Data

US 2009/0089918 A1 Apr. 9, 2009

(30) Foreign Application Priority Data

Oct. 4, 2007 (JP) ..... 2007-260936

(51) Int. Cl.

| | |
|---|---|
| ***A42B 1/06*** | (2006.01) |
| ***A42B 1/08*** | (2006.01) |
| ***A42B 1/24*** | (2006.01) |
| ***A42C 5/04*** | (2006.01) |

(52) U.S. Cl. ..... 2/410; 2/424; 2/422; 2/171.3

(58) Field of Classification Search ..... 2/410, 2/422, 425, 171.3, 414; 454/370; D29/102, D29/103

See application file for complete search history.

(56) References Cited

U.S. PATENT DOCUMENTS

| | | | | | |
|---|---|---|---|---|---|
| 4,964,178 | A | * | 10/1990 | Giancarlo et al. | 2/414 |
| 5,086,520 | A | | 2/1992 | Arai | |
| 5,093,937 | A | * | 3/1992 | Kamata | 2/424 |
| 5,170,510 | A | * | 12/1992 | Nava | 2/414 |
| 5,533,500 | A | * | 7/1996 | Her-Mou | 128/201.25 |
| 5,855,404 | A | * | 1/1999 | Saunders | 296/78.1 |
| 5,996,128 | A | * | 12/1999 | Yanagihara | 2/422 |
| 6,061,834 | A | * | 5/2000 | Liao | 2/171.3 |
| 6,105,172 | A | * | 8/2000 | Shida | 2/171.3 |
| 6,263,513 | B1 | * | 7/2001 | Murakami | 2/171.3 |
| 6,973,676 | B1 | * | 12/2005 | Simpson | 2/171.3 |
| 7,413,506 | B2 | * | 8/2008 | Arai | 454/370 |
| 2004/0158914 | A1 | * | 8/2004 | Tanaka | 2/410 |
| 2005/0066416 | A1 | * | 3/2005 | Ma | 2/171.3 |
| 2006/0248631 | A1 | * | 11/2006 | Arai | 2/424 |
| 2007/0050894 | A1 | * | 3/2007 | Tsurumi | 2/413 |
| 2007/0192942 | A1 | * | 8/2007 | Ahn | 2/410 |

FOREIGN PATENT DOCUMENTS

| | | |
|---|---|---|
| EP | 818156 | 1/1997 |
| JP | 06184804 | 7/1994 |
| JP | 08291422 | 11/1996 |
| JP | 2006-299456 | 11/2006 |

OTHER PUBLICATIONS

English Abstract of JP 2006-299456.
English Abstract of JP 08291422.
English Abstract of JP 06184804.
English Abstract of EP 818156.

* cited by examiner

*Primary Examiner*—Gary L Welch
*Assistant Examiner*—Jane S Yoon
(74) *Attorney, Agent, or Firm*—Dykema Gossett PLLC

(57) ABSTRACT

A wind rectifying member positioned between two ventilation covers on the top of a helmet is adjustably supported by fitting members of support structures mounted within each ventilation cover. The fitting members adjust the forward and rearward positioning of the rectifying member and its angle of tilt relative to the wind direction. The fitting members extend through openings in facing side walls of the ventilation covers and into indentations in the ends of the rectifying member.

3 Claims, 5 Drawing Sheets

HELMET

BACKGROUND OF THE INVENTION

Field of the Invention

The present invention relates to a helmet which is worn to rides on various vehicles, such as a motor cycle, a four-wheel car, a motor boat, a bicycle and so on, and more specifically, to a helmet which has a ventilation structure which ventilates hot air within the helmet and a rectifying structure for separating traveling wind from the surface of the helmet.

As information on a prior-art document related to the present invention, there is provided Patent Document 1, for example.

[Patent Document 1] Japanese Unexamined Patent Application Publication No. 2006-299456

SUMMARY OF THE INVENTION

Patent Document 1 discloses a helmet which includes a rectifying body which separates traveling wind from the surface of the helmet. The rectifying body is provided so as to adjust the angle of a rectifying surface facing the traveling wind in response to unique driving postures of a person wearing the helmet or the speed of a transportation means.

In the helmet disclosed in Patent Document 1, regardless of a difference in unique driving posture of a helmet wearer or speed of a transportation means, the separation of traveling wind is performed, thereby enhancing a ventilation operation and rectifying operation. However, the present applicant has devoted himself to studies for securing the ease of angle change operation while enhancing the reliability of angle maintenance of the rectifying body in the rectifying structure. As a result, the present application has invented the present invention.

In order to achieve the above-mentioned object, an advantage of the present invention is that it provides a helmet which has a function of separating traveling wind while enhancing the reliability of angle maintenance of a rectifying body in a rectifying structure, regardless of a difference in unique driving posture of a helmet wearer or speed of a transportation means and can secure the ease of angle change operation.

According to an aspect of the invention, a helmet includes a rectifying body provided on the surface of a helmet body, the rectifying body being involved in maintaining stability of the helmet against airflow during traveling. The angle of a rectifying surface of the rectifying body facing traveling wind can be adjusted in response to unique driving postures of a helmet wearer or the speed of a transportation means. The rectifying body is supported through a pair of supporting bodies facing a direction crossing the traveling direction so as to be rotatable in a direction against an airflow of traveling wind and in a direction reverse to the direction against the airflow and is supported so as to be slidable to the windward side of the traveling wind and the leeward side thereof. The supporting body includes a bearing member which rotatably and slidably supports the rectifying body; a slide biasing means which applies a windward biasing force to the rectifying body; and a ratchet mechanism which adjusts the facing angle of the rectifying surface in a multistage manner and maintains the facing angle. When the rectifying body is located at the end on the leeward side in the sliding direction, the ratchet mechanism maintains a facing angle holding state in the rectifying surface against a force which rotates the rectifying body in a direction reverse to the direction against the airflow of the traveling wind, and the facing angle holding state is released by sliding the rectifying body in the windward direction.

Further, the supporting body is integrally provided with a fitting member having a fitting projection which can be fitted into and detached from a side end portion of the rectifying body in a direction crossing the traveling wind direction; and a fitting biasing means which applies a biasing force against a force in a direction crossing the traveling wind direction and in a direction away from a side end portion of the rectifying body to the fitting member. The fitting member is supported by the bearing member so as to be rotatable in accordance with the rotation of the rectifying body and to be slidable in accordance with the sliding of the rectifying body.

The ratchet member is provided across the fitting member and the bearing member.

The rectifying body is disposed to extend between two ventilation covers parallel to a traveling direction.

Further, the rectifying body is disposed to extend between two ventilation covers parallel to a traveling direction, and the supporting body is disposed in each of the ventilation covers. A through-hole through which the fitting projection passes is formed in a side end portion of the ventilation cover facing the side end portion of the rectifying body such that the fitting projection passing through the through-hole is fitted into the side end portion of the rectifying body.

That is, the support member (including the ratchet mechanism and so on) supporting the rectifying body and the adjustment mechanism which adjusts the facing angle of the rectifying surface in the rectifying body are constructed so as not to be exposed to the outside of the ventilation cover. Therefore, the design of the helmet can be enhanced. Further, since traveling wind does not act on the support member or the adjustment mechanism, wind noise can be reduced.

In the present invention, the following excellent effects can be expected through the above-described construction.

It is possible to provide a helmet which has a function of separating traveling wind while enhancing the reliability of angle maintenance of a rectifying body in a rectifying structure and can secure the ease of angle change operation of the rectifying body regardless of a difference in unique driving posture of a helmet wearer or speed of a transportation means.

DESCRIPTION OF THE PREFERRED EMBODIMENT

Figure 1:
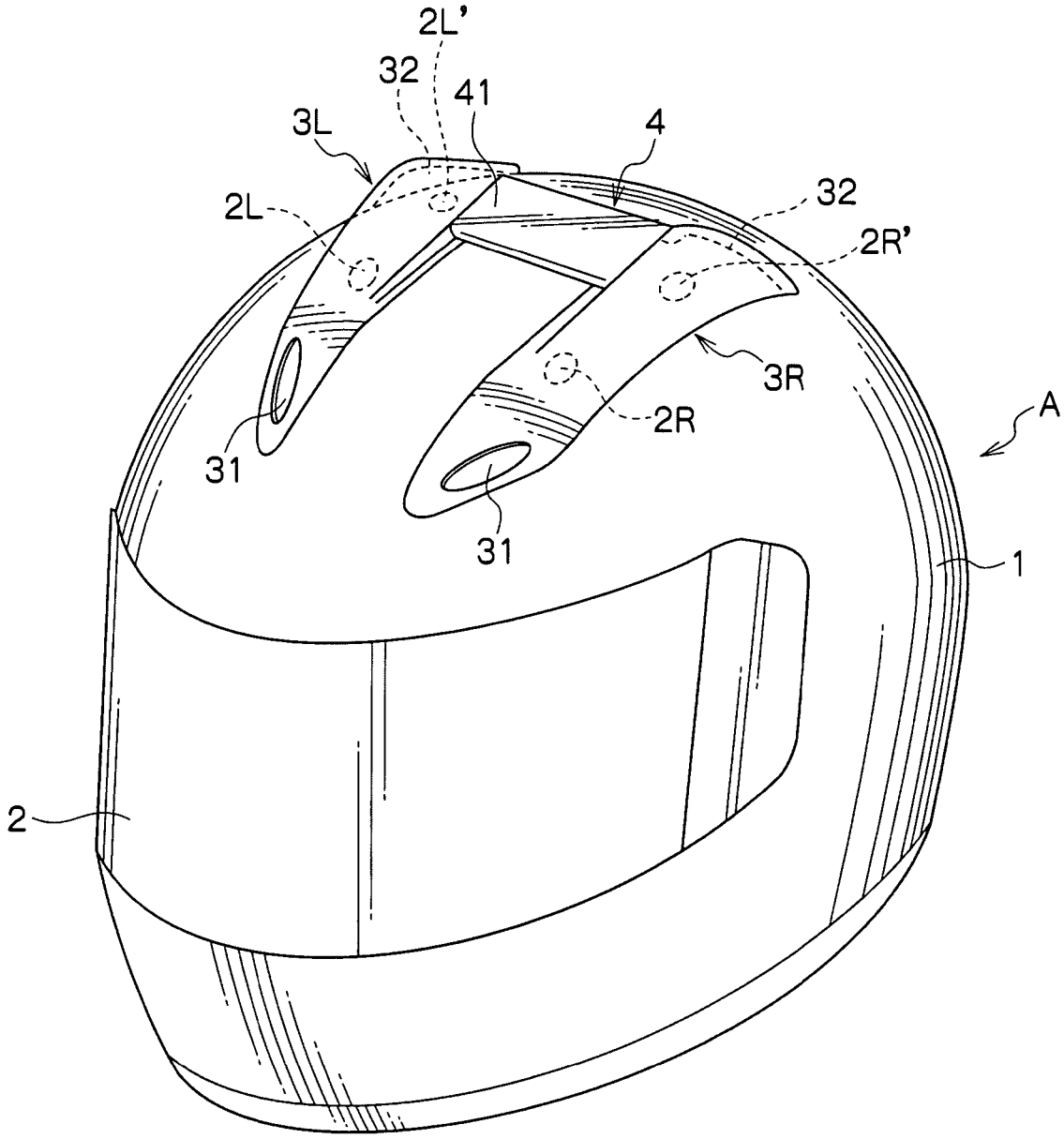
FIG. 1 is a perspective view of a helmet according to the present invention.
Figure 2:
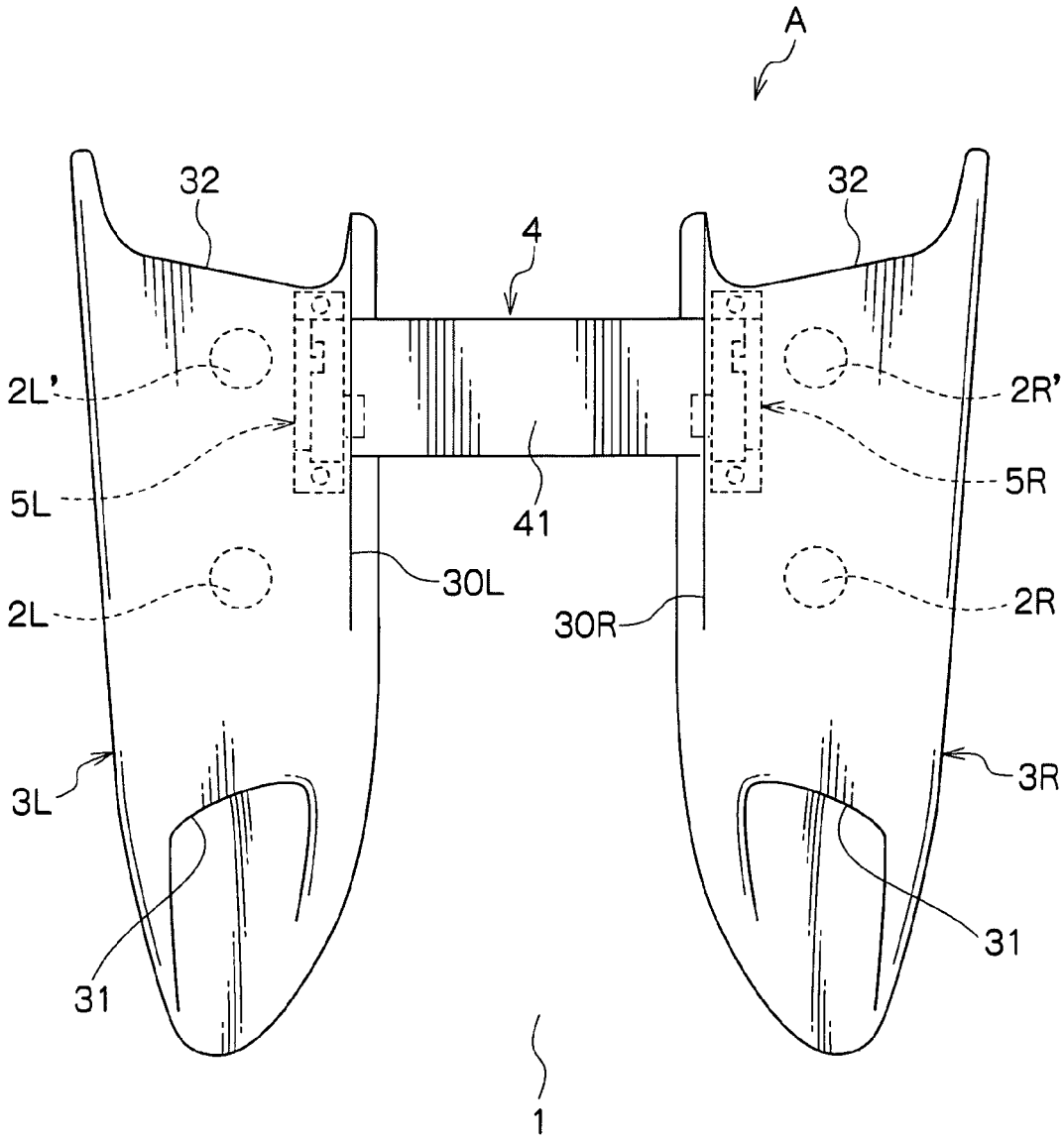
FIG. 2 is a plan view of a portion of the helmet of FIG. 1 which includes the ventilation covers and the rectifying body.

Hereinafter, a helmet according to an embodiment of the present embodiment will be described with reference to the accompanying drawings.

FIGS. 1 to 5 show a helmet according to an embodiment of the present invention.

In this embodiment, a windward side of traveling wind generated during traveling is referred to as the front side, and a leeward side of traveling wind is referred to as the rear side.

Further, a direction crossing the traveling wind is referred to as the left and right direction.

The helmet A exemplified in this embodiment includes an impact absorbing liner Al molded in a predetermined shape using foam polystyrene or a material having the same impact absorbing performance as the foam polystyrene, the impact absorbing liner Al being mounted on the inside of a helmet body 1 molded in a predetermined shape using fiber-reinforced resin (GFRP, CFRP or the like). Further, the helmet A includes a head-portion interior member (not shown) and a cheek pad (not shown), which are formed of urethane or the like and are arranged on the inside of the inside of the impact absorbing liner Al. The helmet body 1 has a shield 2 for opening and closing a front opening portion (not shown) and left and right four ventilation holes 2L, 2R, 2L', and 2R' for discharging hot air within the helmet A. The above-described structure is well-known.

The helmet exemplified in this embodiment is a full face helmet. However, the invention is not limited to the full face helmet, but can be applied to a jet-type helmet or half-type helmet.

In the helmet A according to this embodiment, a pair of ventilation covers 3L and 3R for covering the ventilation holes 2L, 2R, 2L', and 2R' are mounted on the surface of the helmet body 1. Between the ventilation covers 3L and 3R, a rectifying body 4 having a rectifying surface 41 is mounted so as to adjust the facing angle of the rectifying surface 41 with respect to traveling wind (refer to FIG. 5). The rectifying surface 41 rectifies traveling wind while facing the traveling wind acting on the helmet.

The ventilation covers 3L and 3R are formed of elastic synthetic resin which can be deformed and can be restored from the deformation. Further, the ventilation covers 3L and 3R are formed in a tunnel shape so as to guide traveling wind from the front side to the rear side of the helmet body 1. Each of the ventilation covers 3L and 3R has an inlet 31 formed in the front end thereof and an outlet 32 formed in the rear end thereof. By negative pressure generated when traveling wind enters the inlet 31 and then escapes from the outlet 32, hot air within the helmet A is sucked from the ventilation holes 2L, 2R, 2L', and 2R' positioned inside the ventilation covers 3L and 3R so as to be discharged.

Hereinafter, the facing angle adjustment structure of the rectifying body 4 in the helmet A according to this embodiment will be described with reference to FIGS. 2 to 5.

The facing angle adjustment structure is constructed in such a manner that a pair of supporting bodies 5L and 5R fixed to the helmet body 1 support the rectifying body 4.

The supporting bodies 5L and 5R are formed of the same constituent member. Therefore, in FIGS. 3 to 5, only the supporting body 5L is shown. Further, reference numeral with 'L' will be attached to the respective components associated with the supporting body 5L, and reference numeral with 'R' will be attached to the respective components of the supporting body 5R, which correspond to the respective components of the supporting body 5L.

The supporting body 5L or 5R is built in the ventilation cover 3L or 3R. Further, the left or right side end portion 42L or 42R of the rectifying body 4 is supported by a fitting projection 61L or 61R which project from a through-hole 31L or 31R opened in a side end portion 30L or 30R of the ventilation cover 3L or 3R.

The side end portion 42L or 42R of the rectifying body 4 has a fitting concave portion 43L or 43R, into and from which the fitting projection 61L or 61R can be fitted and detached. As the fitting projection 61L or 61R is fitted into the fitting concave portion 43L or 43R, the rectifying body 4 is supported between the ventilation covers 3L and 3R.

More specifically, the supporting body 5L or 5R includes a fitting member 6L or 6R having the above-described fitting projection 61L or 61R integrated therewith, and a bearing member 7L or 7R which supports the fitting member 6L or 6R.

Across the fitting member 6L or 6R and the bearing member 7L or 7R, a support portion 8L or 8R and a ratchet mechanism 9L or 9R are provided. The support portion 8L or 8R rotatably supports the fitting member 6L or 6R in the same direction as the facing-angle adjustment direction of the rectifying surface 41 in the rectifying body 4, and simultaneously, slidably supports the fitting member 6L or 6R in the front and rear direction. The ratchet mechanism 9L or 9R holds the rotational position of the fitting member 6L or 6R, and the holding of the rotational position is released by forward sliding of the fitting member 6L or 6R.

Here, the facing-angle adjustment direction of the rectifying surface 41 in the rectifying body 4 includes a direction in which the rectifying body 4 is against the airflow of traveling wind, and a direction reverse to the direction against the airflow. The rectifying body 4 is supported so as to rotate in both directions.

Hereinafter, the direction against the airflow of traveling wind is referred to as the front direction, and the direction reverse to the direction against the airflow is referred to as the rear direction.

Reference numerals 10L and 10R represent a slide biasing means which applies a biasing force against the forward sliding of the fitting member 6L or 6R toward the rear side so as to hold the rotational position of the fitting member 6L or 6R with respect to the ratchet mechanism 9L or 9R. The slide biasing means 10L or 10R is provided in the bearing member 7L or 7R.

Figure 4:
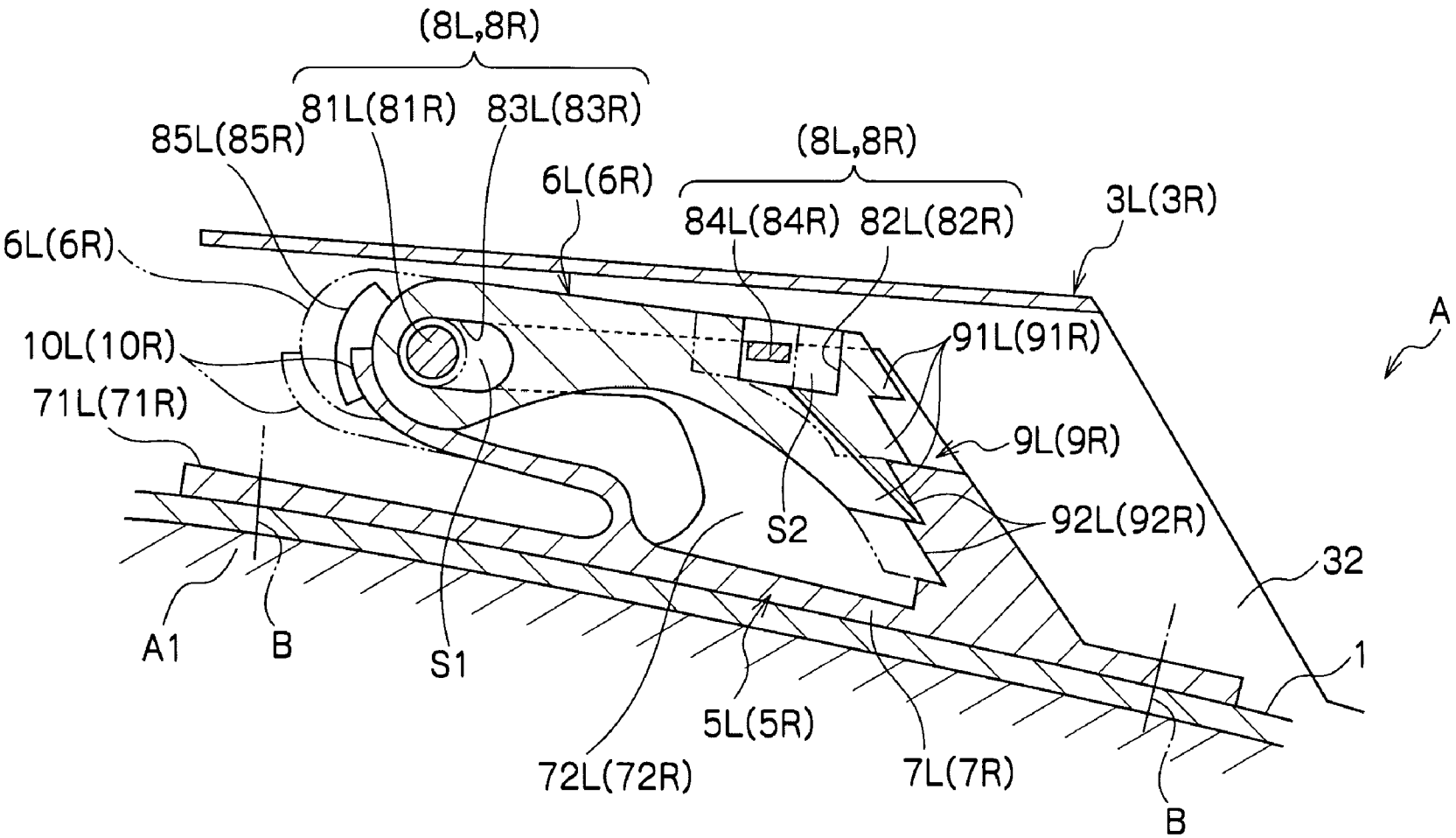
FIG. 4 is a cross-sectional view of line (IV)-(IV) of FIG. 3.
Figure 5:
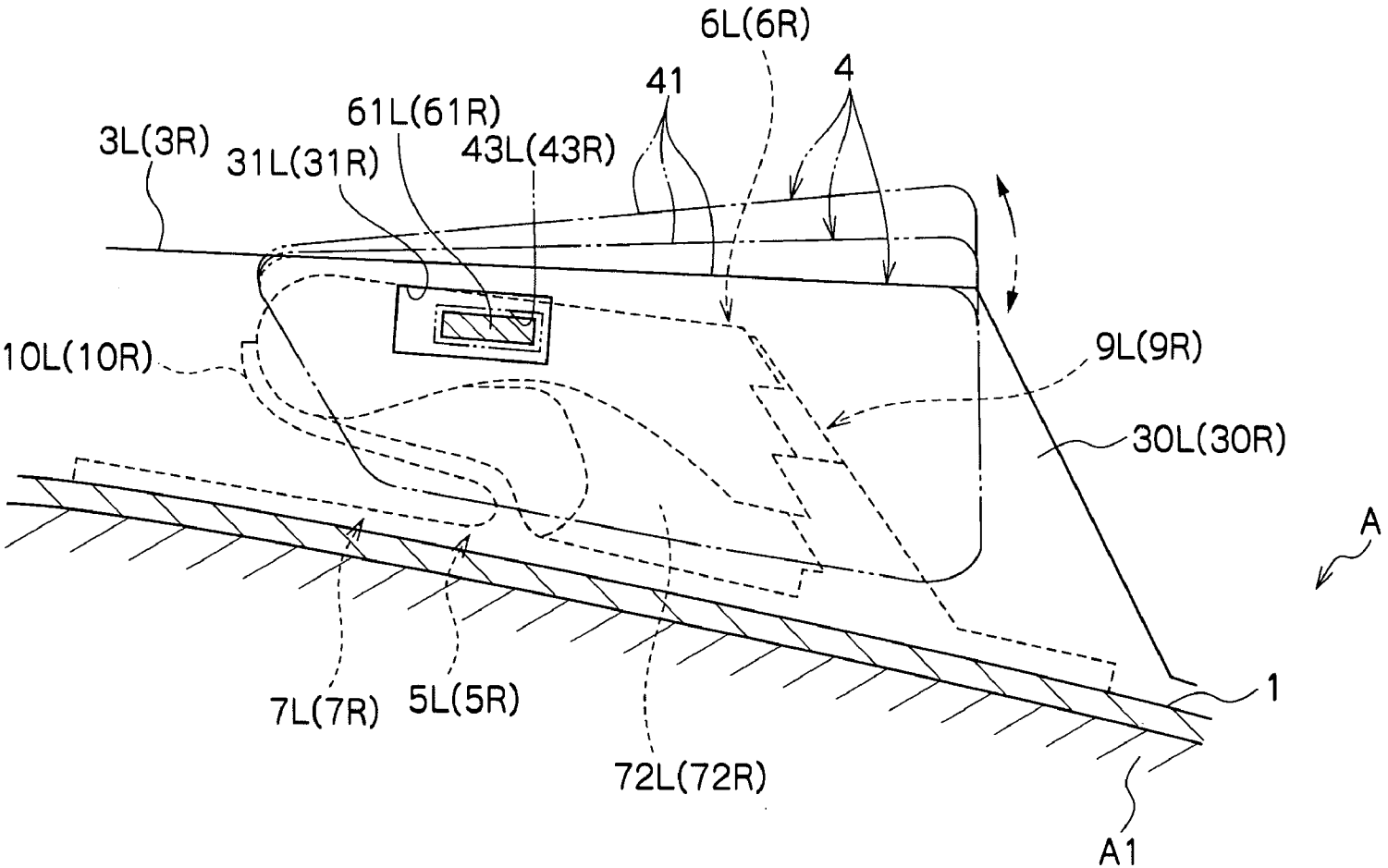
FIG. 5 is a cross-sectional view of line (V)-(V) of FIG. 3.

In FIGS. 4 and 5, the fitting member 6L or 6R has a front end formed in a circular arc which is concentric with a rotation orbit, and the fitting projection 61L or 61R is provided to project from the surface of the fitting member 6L or 6R at the rectifying body 4. On the surface of the fitting member 6L or 6R opposite the fitting projection 61L or 61R, a rotation supporting concave portion 83L or 83R and a rotation guiding concave portion 82L or 82R are provided, which compose one side of the support portion 8L or 8R.

The rotation supporting concave portion 83L or 83R, into which a rotation supporting convex portion 81L or 81R composing the other side of the support portion 8L or 8R is fitted, is formed in the front side of the fitting member 6L or 6R and in an oval shape which is elongated in the front and rear direction.

Further, the rotation guiding concave portion 82L or 82R, into which a rotation guiding convex portion 84L or 84R composing the other side of the support portion 8L or 8R is fitted, is formed in the rear side of the fitting member 6L or 6R. The upper side of the rotation guiding concave portion 82L or 82R is opened from the upper end edge toward the lower side thereof, and the length of the rotation guiding concave portion 83L or 83R in the front and rear direction is set to almost the same length as that of the rotation supporting concave portion 83L or 83R in the front and rear direction.

The fitting member 6L or 6R has a plurality of convex portions 91L or 91R formed in the rear end portion thereof along the vertical direction, the convex portions 91L or 91R composing one side of the ratchet mechanism 9L or 9R.

Reference numerals 85L and 85R represents a guide plate which guides the rotation of the fitting member 6L or 6R and is held by the bearing member 7L or 7R when the fitting member 6L or 6R rotates or slides in the front and rear direction.

The bearing member 7L or 7R is integrally provided with a fixing portion 71L or 71R and a bearing portion 72L or 72R. The fixing portion 71L or 71R fixes the bearing member 7L or 7R to the helmet body 1 through a fixing screw B, and the bearing portion 72L or 72R supports the fitting member 6L or 6R.

The fixing portion 71L or 71R is formed of a thin plate with a curved surface which fits into a curved surface of the helmet body 1. The fixing screw B is fastened in the front and rear end sides thereof such that the slide biasing means 10L or 10R in the middle of the top surface, the bearing portion 72L or 72R in the rear side of the slide biasing means 10L or 10R, and a plurality of concave portions 92L or 92R in the rear end portion are integrally formed, the concave portion 92L or 92R composing the other side of the ratchet mechanism 9L or 9R.

The bearing portion 72L or 72R is erected on the edge portion of the fixing portion 71L or 72R at the left or right side end portion 42L or 42R of the rectifying body 4, with the fitting member 6L or 6R interposed therebetween.

The rotation supporting convex portion 81L or 81R composing the other side of the support portion 8L or 8R is provided to project from a portion of the bearing portion 72L or 72R facing the rotation supporting concave portion 83L or 83R. Further, the rotation guiding convex portion 84L or 84R composing the other side of the support portion 8L or 8R is provided to project from a portion of the bearing portion 72L or 72R facing the rotation guiding concave portion 82L or 82R.

The rotation supporting convex portion 81L or 81R serves as the rotation center of the fitting member 6L or 6R and is formed in a substantially cylindrical shape with a diameter which fits into the vertical width of the rotation supporting concave portion 83L or 83R.

That is, when the rotation supporting convex portion 81L or 81R is fitted into the rotation supporting concave portion 83L or 83R, a space S1 for the forward and rearward sliding of the fitting member 6L or 6R is secured inside the rotation supporting concave portion 83L or 83R.

As the fitting member 6L or 6R is rotated inside the rotation guiding concave portion 82L or 82R with the above-described rotation center, the rotation guiding convex portion 84L or 84R is moved along the rotation orbit (vertical direction). The rotation guiding convex portion 84L or 84R is formed in a substantially square shape.

The rotation guiding convex portion 84L or 84R has a front and rear width smaller than that of the rotation guiding concave portion 82L or 82R, and the front and rear width is set in such a manner that a space S2 for the forward and rearward sliding of the fitting member 6L or 6R is secured, the space S2 having almost the same width as the front and rear width of the space S1.

As the convex portions 91L or 91R are engaged with the concave portions 92L or 92R, the ratchet mechanism 9L or 9R holds the rotating position of the fitting member 6L or 6R. As the engagement of the convex portion 91L or 91R with the concave portion 92L or 92R is released, the fitting member 6L or 6R can be rotated.

As the engagement position of the convex portion 91L or 91R with respect to the concave portion 92L or 92R is changed, the held position (facing angle) of the fitting member 6L or 6R can be changed.

The convex portion 91L or 91R and the concave portion 92L or 92R are formed in a blade shape such that when the convex portion 91L or 91R and the concave portion 92L or 92R are engaged with each other, the engagement state is maintained against a force which rotates the fitting member 6L or 6R in the rear direction, and the engagement of the convex portion 91L or 91R with the concave portion 92L or 92R can be released with respect to the rotation and sliding of the fitting member 6L or 6R in the front direction (refer to FIGS. 4 and 5).

According to the ratchet mechanism 9L or 9R, traveling wind acting on the rectifying body 4 serves as a force which rotates the rectifying body 4 in the rear direction and serves to rotate the fitting member 6L or 6R in the rear direction, the fitting member 6L or 6R supporting the rectifying body 4. At this time, however, as the engagement of the convex portion 91L or 91R with the concave portion 92L or 92R is maintained, the rotation of the fitting member 6L or 6R in the rear direction is restricted. Therefore, it is possible to prevent the position of the rectifying body 4 from being changed by the traveling wind.

Adversely, when an artificial force which rotates the rectifying body 4 in the front direction is applied, this force acts so as to rotate the fitting member 6L or 6R in the front direction. At this time, since the engagement of the convex portion 91L or 91R with the concave portion 92L or 92R is released, the rectifying body 4 can be rotated in the front direction.

Further, when an artificial force which slides the rectifying body 4 in the front direction is applied, the engagement of the convex portion 91L or 91R with the concave portion 92L or 92R is released, so that the rectifying body 4 can be rotated in the front and rear direction.

The slide biasing means 10L or 10R is disposed in the front side of the fitting member 6L or 6R and is formed in a plate spring shape which always comes in contact with the front end portion of the fitting member 6L or 6R. The slide biasing means 10L or 10R has a function of applying a biasing force which rearward slides the fitting member 6L or 6R against the forward sliding of the fitting member 6L or 6R.

That is, as the slide biasing means 10L or 10R holds the fitting member 6L or 6R in the rear direction, the engagement state between the convex portion 91L or 91R and the concave portion 92L or 92R of the ratchet mechanism 9L or 9R can be maintained.

Further, with the forward sliding of the fitting member 6L or 6R, the slide biasing means 10L or 10R is pressed against the fitting member 6L or 6R so as to be deformed. Simultaneously, a biasing force is generated, which presses the fitting member 6L or 6R in the rear direction such that the fitting member 6L or 6R is restored.

The portion of the slide biasing means 10L or 10R, which comes in contact with the front end portion of the fitting member 6L or 6R, is formed in a circular arc which fits into the circular arc of the front end portion. The circular arc serves to guide the rotation of the fitting member 6L or 6R.

The bearing member 7L or 7R is formed of elastic synthetic resin, which can be deformed and restored from the deformation.

According to the bearing member 7L or 7R formed of synthetic resin, as a force which expands the bearing portion 72L or 72R in the right and left direction is applied, the bearing portion 72L or 72R is obliquely deformed. Further, as the expanding force is released, the bearing portion 72L or 72R is restored from the oblique deformation such that the fitting concave portion 43L or 43R of the side end portion 42L or 42R in the rectifying body 4 can be engaged with the fitting projection 61L or 61R. In such a manner, a fitting biasing means is constructed.

Further, the slide biasing means 10L or 10R formed of a plate spring, which generates the biasing force, can be formed.

Figure 3:
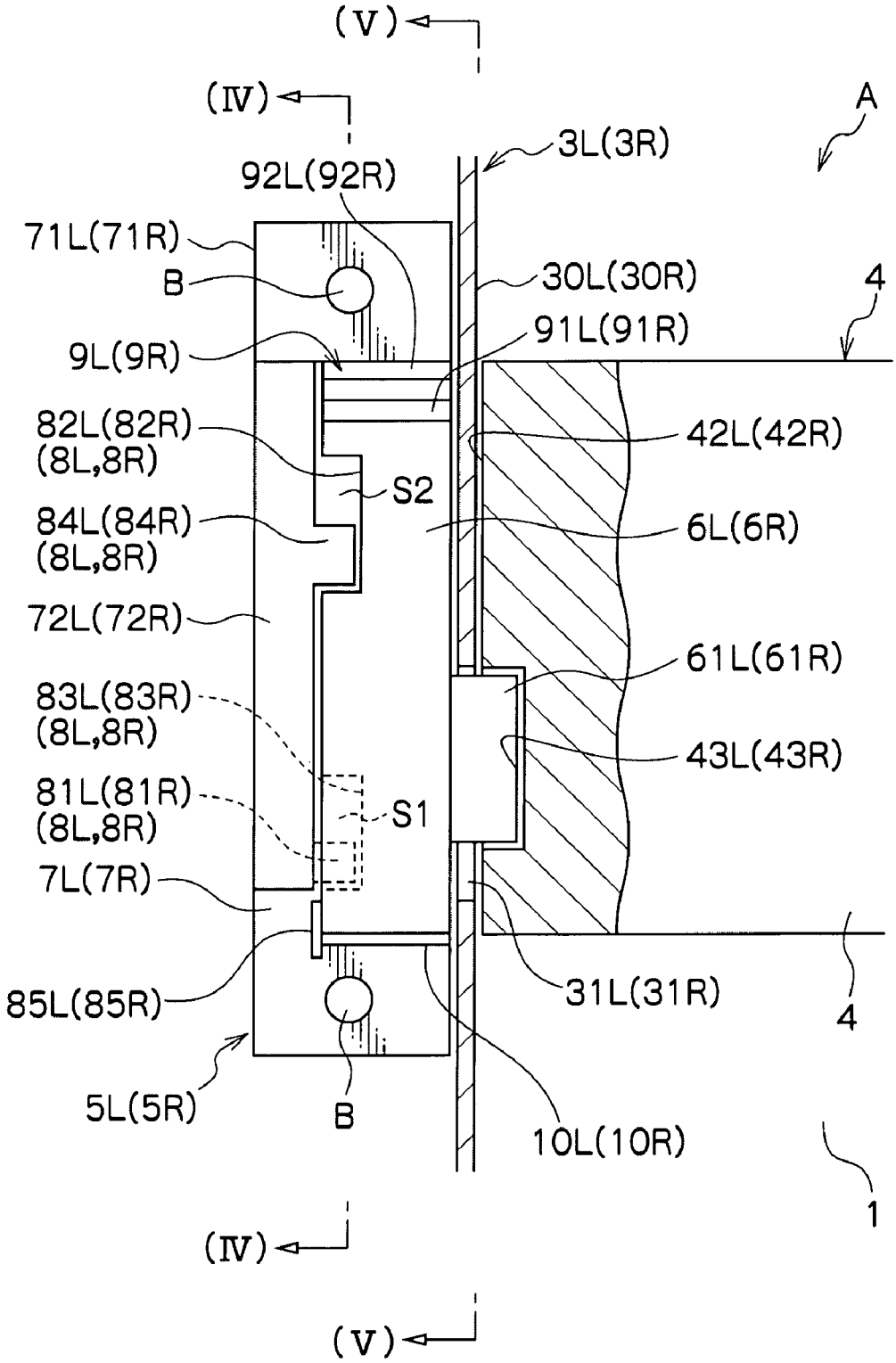
FIG. 3 is an expanded view of essential parts of the helmet.

That is, as the rectifying body 4 is pressed toward the left side of FIG. 3, the side end portion 42R of the rectifying body 4 deforms the side end portion 30R of the ventilation cover 3R in a direction for the supporting body 5R. As the side end portion 30R is deformed, the support portion 72R is pressed toward the right side through the fitting member 6R so as to be obliquely deformed.

At this time, since the side end portion 42L of the rectifying body 4 is also moved to the right side, the fitting concave portion 43L of the side end portion 42L is detached from the fitting projection 61L of the fitting member 6L.

In this state, the side end portion 42L of the rectifying body 4 is pulled up and is then moved to the left side such that the fitting concave portion 43R of the right side end portion 42R is removed from the fitting projection 61R. Then, the rectifying body 4 can be detached from the helmet A.

When the rectifying body 4 is detached, the bearing portion 72R is restored to the original shape from the deformation by the biasing force of the fitting biasing means.

When the rectifying body 4 is attached to the helmet A, the attaching can be achieved by performing the detaching operation in the reverse order.

In this embodiment, it has been exemplified that the supporting body 5L or 5R is built in the ventilation cover 3L or 3R. However, the invention is not limited to this embodiment, but includes an embodiment in which the supporting body 5L or 5R is provided outside the ventilation cover 3L or 3R.

Hereinafter, the facing angle adjustment operation of the rectifying body 4 of the helmet A according to this embodiment will be described.

In an facing angle holding state of the rectifying body 4, the slide biasing means 10L or 10R holds the fitting member 6L or 6R in the rear position, and the engagement state between the convex portion 91L or 91R and the concave portion 92L or 92R of the ratchet mechanism 9L or 9R is maintained.

Further, as a force in a direction which forward rotates the rectifying body 4 from the facing angle holding state is applied, the engagement between the convex portion 91L or 91R and the concave portion 92L or 92R of the ratchet mechanism 9L or 9R is released by the biasing force of the slide biasing means 10L or 10R. Further, while sliding forward and rearward, the fitting member 6L or 6R is rotated upward. Simultaneously, the rectifying body 4 is forward rotated in accordance with the rotation of the fitting member 6L or 6R.

In the forward rotation of the rectifying body 4, the biasing force of the slide biasing means 10L or 10R acts on the fitting member 6L or 6R. Therefore, when the force which rotates the rectifying body 4 upward is released, the concave portion 91L or 91R of the ratchet mechanism 9L or 9R is inevitably restored to the engagement state with respect to the concave portion 92L or 92R. Then, the facing angle of the rectifying body 4 is maintained.

Further, a force is applied to forward slide the rectifying body 4 from the facing angle holding state of the rectifying body 4. Then, in accordance with the sliding, the fitting member 6L or 6R is forward slid against the biasing force of the slide biasing means 10L or 1R, and the engagement between the concave portion 91L or 91R and the convex portion 92L or 92R of the ratchet mechanism 9L or 9R is released. Then, the rectifying body 4 can be rotated in the rear direction in a state where the rectifying body 4 is forward slid.

Further, in a state where the rectifying body 4 is rotated to a target position, the force applied to the rectifying body 4 in the sliding direction is released. Then, the fitting member 6L or 6R is slid in the rear direction by the biasing force of the slide biasing means 10L or 10R, and the convex portion 91L or 91R of the ratchet mechanism 9L or 9R is inevitably restored to the engagement state with respect to the concave portion 92L or 92R such that the facing angle of the rectifying body 4 is maintained.

According to the facing angle adjustment structure of the rectifying body 4, the facing angle of the rectifying body 4 can be arbitrarily adjusted. Further, the rearward rotation of the rectifying body 4 during traveling is prevented by the engagement between the convex portion 91L or 91R and the concave portion 92L or 92R of the ratchet mechanism 9L or 9R. Therefore, although traveling wind acts as a force which rotates the rectifying body 4 in the rearward direction, the angle of the rectifying body 4 is not changed, and the set facing angle can be reliably maintained.

Further, the rearward rotation of the rectifying body 4 can be performed by only the above-described artificial operation with respect to the rectifying body 4. In the engagement state between the convex portion 91L or 91R and the concave portion 92L or 92R of the ratchet mechanism 9L or 9R, although an artificial force which rotates the rectifying body 4 in the rear direction is applied, the rectifying body 4 is not rotated. Therefore, although a wearer of the helmet A inadvertently applies an artificial force which rotates the rectifying body 4 in the rear direction, the angle of the rectifying body 4 is not changed, and the set facing angle can be reliably maintained.

As described above, since only the rectifying body 4 can be attached and detached, an exchange operation of the rectifying body 4 can be performed easily.

As the supporting body 5L or 5R is built in the ventilation cover 3L or 3R, the respective components composing the facing angle adjustment structure of the rectifying body 4 are not seen from the outside of the helmet A. Therefore, the design of the helmet A can be enhanced.

While the present invention has been described with reference to exemplary embodiments thereof, it will be understood by those skilled in the art that various changes and modifications in form and detail may be made therein without departing from the scope of the present invention as defined by the following claims.

DESCRIPTION OF THE REFERENCE SYMBOLS

A: HELMET
1: HELMET BODY
2L: VENTILATION HOLE
2R: VENTILATION HOLE
2L': VENTILATION HOLE
2R': VENTILATION HOLE
3L: VENTILATION COVER
3R: VENTILATION COVER
30L: SIDE END PORTION
30R: SIDE END PORTION
31L: THROUGH-HOLE
31R: THROUGH-HOLE
4: RECTIFYING BODY
41: RECTIFYING SURFACE
42L: SIDE END PORTION
42R: SIDE END PORTION
43L: FITTING CONCAVE PORTION
43R: FITTING CONCAVE PORTION
5L: SUPPORTING BODY
5R: SUPPORTING BODY
6L: FITTING MEMBER
6R: FITTING MEMBER
61L: FITTING PROJECTION
61R: FITTING PROJECTION
7L: SUPPORT MEMBER

7R: SUPPORT MEMBER
81L: ROTATION SUPPORTING CONVEX PORTION
81R: ROTATION SUPPORTING CONVEX PORTION
83L: ROTATION SUPPORTING CONCAVE PORTION
83R: ROTATION SUPPORTING CONCAVE PORTION
9L: RATCHET MECHANISM
9R: RATCHET MECHANISM
91L: CONVEX PORTION
91R: CONVEX PORTION
92L: CONCAVE PORTION
92R: CONCAVE PORTION
10L: SLIDE BIASING MEANS
10R: SLIDE BIASING MEANS
S1: SPACE
S2: SPACE

What is claimed is:

1. A helmet which comprises a helmet body which defines front and back sides relative to wind flow, right and left ventilation covers attached to the body to extend generally in parallel with wind flow, said ventilation covers including facing sides walls which define respective openings that are in register with one another, an adjustable rectifying member positioned between said left and right ventilation covers, said rectifying member providing an upper surface over which wind can flow and left and right sides which define indentations respectively aligned with the openings in the facing side walls of the right and left ventilation covers, and respective left and right support mechanisms in said left and right ventilation covers, each support mechanism including a support body attached to the helmet body which includes a bearing member that defines a biasing means at a forward end and ratchet steps at a rearward end, and a fitting member which is pivotally mounted at a forward end and defines ratchet teeth at a rearward end, said ratchet teeth cooperating with said ratchet steps to provide a ratchet mechanism, said fitting member including a fitting element which extends through a respective opening in the side wall of the associated ventilation cover and into an indentation in an adjacent end of the rectifying member to achieve forward, rearward and rotational adjustment of the rectifying member.

2. The helmet according to claim 1, wherein each support mechanism includes a bearing portion on a side of said fitting member opposite the side wall of the associated ventilation cover, said bearing portion including a rotation supporting convex member which extends into a first elongated blind bore in the fitting member.

3. The helmet according to claim 2, wherein each bearing portion includes rotation guiding convex member which extends into a second elongated blind bore in the fitting member.

* * * * *